US007815559B1

(12) United States Patent
Flaming

(10) Patent No.: US 7,815,559 B1
(45) Date of Patent: Oct. 19, 2010

(54) APPARATUS AND METHOD FOR FORMING A STACKABLE CONTAINERS

(75) Inventor: Max Flaming, Fresno, CA (US)

(73) Assignee: Maxco Supply, Inc., Parlier, CA (US)

( * ) Notice: Subject to any disclaimer, the term of this patent is extended or adjusted under 35 U.S.C. 154(b) by 19 days.

(21) Appl. No.: 12/183,025

(22) Filed: Jul. 30, 2008

Related U.S. Application Data

(60) Provisional application No. 60/952,820, filed on Jul. 30, 2007.

(51) Int. Cl.
*B31B 1/44* (2006.01)

(52) U.S. Cl. ..... 493/75; 493/73; 493/81; 493/84; 493/183; 493/416

(58) Field of Classification Search ..... 493/52, 493/56, 67–73, 75, 79–81, 84, 89, 162, 183, 493/405, 408, 416, 446, 455
See application file for complete search history.

(56) References Cited

U.S. PATENT DOCUMENTS 4,052,933 A * 10/1977 Royal ..... 493/171
4,283,190 A * 8/1981 Williams et al. ..... 493/131
4,624,653 A * 11/1986 McBride et al. ..... 493/127
4,708,704 A * 11/1987 Focke et al. ..... 493/151
4,905,834 A 3/1990 Mur Gimeno et al.
5,156,583 A * 10/1992 Baas ..... 493/140
5,527,254 A * 6/1996 Taliaferro ..... 493/180
5,632,713 A * 5/1997 Canning et al. ..... 493/162
5,860,590 A 1/1999 Blomfield et al.
6,604,675 B2 8/2003 Southwell
6,641,032 B1 11/2003 Schilling
2002/0125308 A1 9/2002 McLeod

* cited by examiner

*Primary Examiner*—Christopher Harmon
(74) *Attorney, Agent, or Firm*—The Law Offices of Andrew D. Fortney; Andrew D. Fortney; Theresa J. Mahan

(57) ABSTRACT

Apparatus and method for forming a stackable container from a container blank. The apparatus generally includes a blank feeder configured to place the blank on a conveyor, an index folder configured to pre-fold a plurality of inner fold-down flaps and an index flap over each of two opposing sidewall flaps of the blank, and a pressure former configured to attach a first leading extension to a leading wall of the blank and a first trailing extension to a trailing wall of the blank, wherein the first leading extension and the first trailing extension are foldably attached at an angle of about 90 degrees to one of the inner fold-down flaps or one of the sidewall flaps. Embodiments of the present the present invention can advantageously provide a reliable approach for forming a container from a blank with relatively fewer folding defects.

27 Claims, 5 Drawing Sheets

APPARATUS AND METHOD FOR FORMING A STACKABLE CONTAINERS

CROSS REFERENCE TO RELATED APPLICATIONS

This application claims the benefit of U.S. Provisional Patent Application No. 60/952,820, filed Jul. 30, 2007, incorporated herein by reference in its entirety.

FIELD OF THE INVENTION

The present invention generally relates to the field of forming packaging containers. More specifically, embodiments of the present invention pertain to apparatuses and methods for forming a stackable container from a container blank.

DISCUSSION OF THE BACKGROUND

In many areas of commerce, containers and, in particular, stackable containers are used to hold and/or transport products. For the area of produce (e.g., fresh fruits and vegetables), such stackable containers are particularly important. Conventional packaging containers are typically formed from blanks made of corrugated board. Such corrugated board generally contains two outer layers of paperboard or cardboard (which generally has a relatively heavy weight), with an inner layer of corrugation (e.g., corrugated paper), but it may contain further layers (e.g., of an external paper or plastic sheet for further support, waterproofing and/or marking, e.g., with advertising and/or identification information; a further inner layer or sheet [e.g., of paper or plastic] between two layers of corrugation; etc.) or contain different materials (e.g., plastic sheet having a relatively high stiffness or modulus of elasticity).

Such packaging containers are generally formed from container blanks Container blanks are pre-cut (e.g., to cut out the outline of the blank, cut holes within the bank [e.g., for ventilation, indexing, grip locations, and/or other purposes], and/or to cut separations lines between flaps or other features of the container). The blanks are generally pre-scored to facilitate folding the blank along desired fold-lines. In addition, container blanks may be printed on one or both sides for identification and/or marketing purposes.

Container blanks may be folded manually to form erected containers. However, to improve efficiency and uniformity and to reduce labor costs it is often preferable to form the containers automatically in a machine configured for the purpose. Existing container forming machines suffer from some drawbacks. For example, the act of folding the cardboard along a fold-line may cause a deformity or bulging in the container material near the fold line if the surfaces of the blank are not adequately supported, especially if the blank has cut-out areas (e.g., ventilation holes) close to the fold-line. Containers deformed in this manner may not be commercially acceptable, so that the efficiency and/or useful throughput of the forming apparatus is reduced.

Therefore it is desirable to provide an apparatus and method for automatically forming containers with good uniformity of result.

SUMMARY OF THE INVENTION

Embodiments of the present invention relate to apparatuses and methods for forming container structures (e.g., by assembling pre-cut and/or pre-scored blanks).

In one embodiment, the invention relates to an apparatus for forming a stackable container from a container blank. The apparatus generally includes a blank feeder configured to place the blank on a conveyor, an index folder configured to pre-fold a plurality of inner fold-down flaps and an index flap over each of two opposing sidewall flaps of the blank, and a pressure former configured to attach a first leading extension to a leading wall of the blank and a first trailing extension to a trailing wall of the blank, wherein the first leading extension and the first trailing extension are foldably attached at an angle of about 90 degrees to one of the inner fold-down flaps or one of the sidewall flaps.

In a further embodiment, the index folder has two holding members (e.g., rods, bars, etc.), where each holding member is held against an inner surface of one of the opposing wall flaps, approximately at a fold line between the sidewall flap and the inner fold-down flaps. A fold line between the index flap and the sidewall flap is generally higher than the fold line between the sidewall flap and at least one of the inner fold-down flaps, thereby forming index tabs for aligning the formed container with index slots in other containers.

Each of the holding members may have a straight section along the length of the sidewall flap, and may further have a guide section angled away from the inner surface of the sidewall flap (e.g., for guiding the blank into the proper position as it is moved along the conveyor). The conveyor may be configured to move the blank from the blank feeder to the index folder and the pressure former. In another embodiment, the index folder further comprises two folding members, each folding member configured to push the inner fold-down flaps and the index flap over each of the opposing sidewall flaps.

In yet another embodiment, the first leading extension is foldably attached at an angle of approximately 90 degrees to an edge of the sidewall flap nearest the leading wall and the first trailing extension is foldably attached at an angle of approximately 90 degrees to an edge of the sidewall flap nearest the trailing wall. In a further embodiment, the pressure former is further configured to attach a second leading extension foldably attached to one of the inner fold-down flaps to the first extension and to attach a second trailing extension foldably attached to one of the inner fold-down flaps to the first trailing extension. In some embodiments, the second leading extension and the second trailing extension may each comprise a corner post section and an attachment section, wherein the corner post section is foldably attached to one of the inner fold-down flaps and the attachment section is foldably attached to the corner post section.

In a further embodiment, the pressure former is further configured to fold each of the corner post sections at an angle of from 30 degrees to 60 degrees with respect to one of the sidewall flaps, fold each of the attachment sections at an angle of approximately 90 degrees with respect to one of the sidewall flaps, and attach each of the attachment sections to one of the first leading extensions or the first trailing extensions (thereby forming, e.g., a gusset or corner support structure in the corners of the container). In a still further embodiment, the pressure former further comprises a press (e.g., a pneumatic press) configured to push one of the attachment sections against one of the first leading extensions or the first trailing extensions.

In another embodiment, the apparatus further comprises an adhesive applicator configured to apply adhesive to one or more surfaces of the blank. The adhesive may comprise, for example, adhesive tape and/or hot-melt glue. In yet another embodiment, the blank feeder has at least one picker arm having a plurality of vacuum cups mounted thereon. The picker arm may be configured to pull the blank between plow structures configured to fold the sidewalls (and the fold-down flaps attached to the sidewalls) at an angle of approximately 90 degrees with respect to the base.

An embodiment of a method for forming a stackable container from a container blank the method includes the steps of placing the blank on a conveyor, pre-folding a plurality of inner fold-down flaps and an index flap over each of two opposing sidewall flaps of the blank, and attaching a first leading extension to a leading wall of the blank and a first trailing extension to a trailing wall of the blank, wherein the first leading extension and the first trailing extension are foldably attached at an angle of about 90 degrees to one of the inner fold-down flaps or one of the sidewall flaps.

In a further embodiment, the pre-folding includes holding a first rod against an inner surface of one of the opposing wall flaps and approximately at a fold line between the sidewall flap and at least one of the inner fold-down flaps. In a still further embodiment, a fold line between the index flap and the sidewall flap is higher than the fold line between the sidewall flap and at least one of the inner fold-down flaps. The pre-folding step may also include pushing the inner fold-down flaps and the index flap over each of the opposing sidewall flaps.

In another embodiment, the attaching step includes folding the first leading extension at an angle of approximately 90 degrees to an edge of the sidewall flap nearest leading wall and folding the first trailing extension at an angle of approximately 90 degrees to an edge of the sidewall flap nearest the trailing wall. In a further embodiment, the method includes attaching a second leading extension foldably attached to one of the inner fold-down flaps to the first extension and attaching a second trailing extension foldably attached to one of the inner fold-down flaps to the first trailing extension.

In one exemplary embodiment, the second leading extension and the second trailing extension each comprise a corner post section and an attachment section, wherein the corner post section is foldably attached to one of the inner fold-down flaps and the attachment section is foldably attached to the corner post section. In a further embodiment, the method includes folding each of the corner post sections at an angle of from 30 degrees to 60 degrees with respect to one of the sidewall flaps, folding each of the attachment sections at an angle of approximately 90 degrees with respect to one of the sidewall flaps, and attaching each of the attachment sections to one of the first leading extensions or the first trailing extensions. In a still further embodiment, the method includes pushing (e.g., with a pneumatic press) one of the attachment sections against one of the first leading extensions or the first trailing extensions. Alternatively, the second extensions may comprise single sections folded at an angle of approximately 90 degrees to the sidewall flap (e.g., parallel to the first extension flaps and the leading and/or trailing flaps).

In another embodiment, the method includes applying adhesive to one or more surfaces of the blank. The adhesive may comprise adhesive tape and/or hot-melt glue. In yet another embodiment, the placing step includes forming a negative pressure in a plurality of vacuum cups attached to at least one picker arm, applying the vacuum cups to the blank, and pulling the blank between plow structures thereby folding the sidewalls at an angle of approximately 90 degrees with respect to the base. In still another embodiment, the method includes moving the blank on the conveyor from a blank feeder configured to perform the placing to an index folder configured to perform the pre-folding and to a pressure former configured to perform the attaching.

Embodiments of the present invention can advantageously provide a reliable approach for forming a container from a blank with relatively fewer folding defects.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications, and equivalents that may be included within the spirit and scope of the invention as defined by the appended claims. Furthermore, in the following detailed description of the present invention, numerous specific details are set forth in order to provide a thorough understanding of the present invention. However, it will be readily apparent to one skilled in the art that the present invention may be practiced without these specific details.

Figure 2:
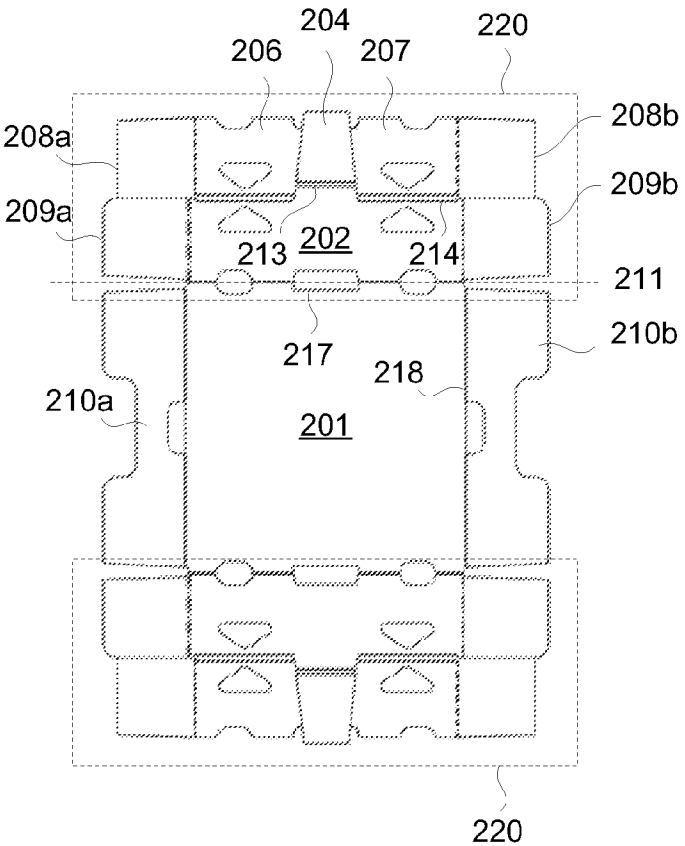
FIG. 2 is a drawing of an alternative exemplary container blank.
Figure 1:
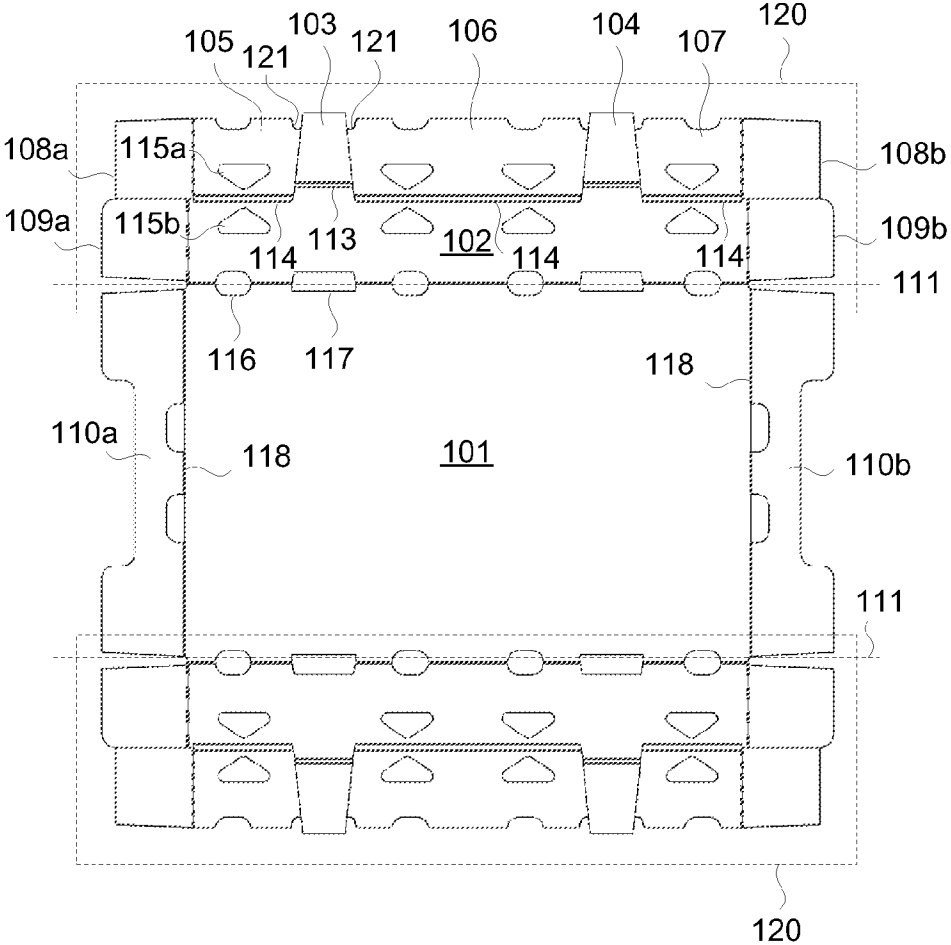
FIG. 1 is a drawing of an exemplary container blank.

Embodiments of the present invention can advantageously provide a reliable approach for forming a container from a blank with relatively fewer folding defects. may be particularly advantageous for forming stackable containers from blanks such as those shown in FIGS. 1 and 2, and as described in U.S. Provisional Patent Application No. 60/952,812, filed on Jul. 30, 2007, the relevant portions of which are hereby incorporated by reference.

An Exemplary Apparatus

Figure 3:
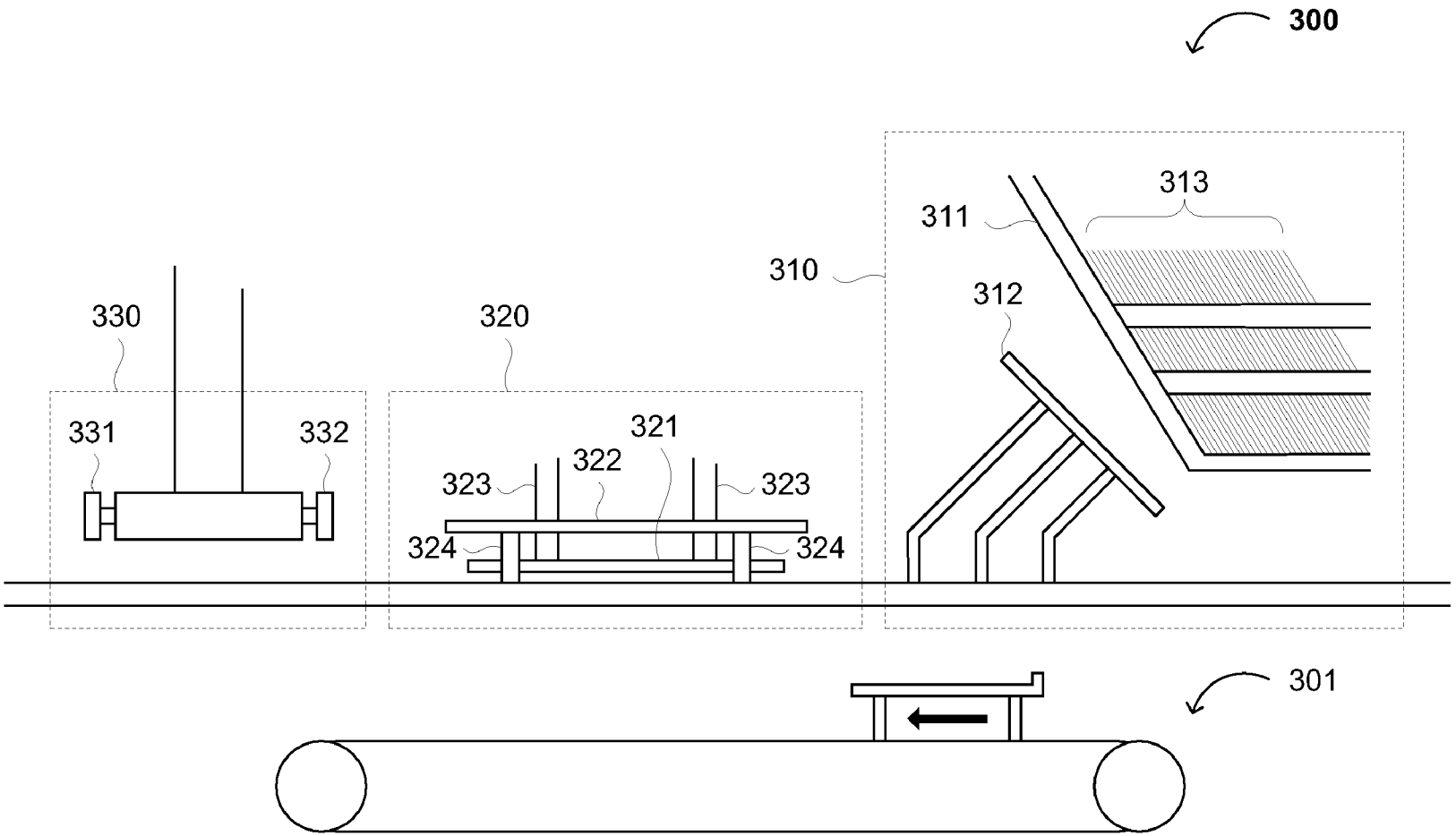
FIG. 3 is a drawing of an exemplary apparatus for forming a container from a container blank.

Referring now to FIG. 3, an exemplary apparatus 300 for forming a stackable container from a container blank is shown. The apparatus 300 generally includes a blank feeder 310, an index folder 320, and a pressure former 330. Blank feeder 310 is generally configured to place a blank (e.g., a blank such as blank 100 of FIG. 1, blank 200 of FIG. 2, or other blank) on a conveyor 301. Index folder 320 is generally configured to pre-fold a plurality of inner fold-down flaps (e.g., inner fold-down flaps 105, 106, and 107 of blank 100 or inner fold-down flaps 406 and 407 of blank 200) and an index flap (e.g., index fold-down flaps 303 and 304 of blank 100 or index flap 204 of blank 200) over each of two opposing sidewall flaps of the blank (e.g., sidewall flap 102 of blank 100 or sidewall flap 202 of blank 200). Pressure former 330 is generally configured to attach a first leading extension to a leading wall of the blank (e.g., leading wall 110*a*) and a first trailing extension to a trailing wall of the blank (e.g., trailing wall 110*b*). The extensions are foldably attached to one of the inner fold-down flaps (e.g., extensions 109 foldably attached to sidewall 302) or to one of the inner fold-down flaps (e.g., extensions 108, foldably attached to inner fold-down flaps 105 and 107). The pressure former 330 generally folds the extensions at an angle of approximately 90 degrees with respect to the sidewall, so that they are parallel to the leading and trailing walls.

Exemplary blank feeder 310 has a magazine 311 for holding a plurality of blanks 313 at an angle of from about 60 degrees to about 80 degrees, and a plows 313 on each side of the apparatus for folding up the sidewalls of each blank (e.g., sidewall structure 120 of blank 100 or sidewall structure 220 of blank 200) as the blank is pulled down. Blank feeder 310 may include at least one picker arm (not shown) having a plurality of vacuum cups mounted thereon, configured to pull the blank between plow structures 312 to fold the sidewall at an angle of approximately 90 degrees with respect to the base. Conveyor 301 may be configured to move the blank from the blank feeder 310 to the index folder 320 and the pressure former 330. Conveyor 301 may comprise a continuous shuttle system (e.g., a "walking beam" transport system) configured to move the blank from the blank feeder 310 through the index folder 320, and deposit the partially folded blank at the pressure former 330, where adhesive may be applied and final folding and pressing steps performed to finish the container.

Index folder 320 has a holding member 321 (e.g., a rods, bar, etc.) and a folding member 322 on each side of the blank. Each holding member 321 is held against an inner surface of one of the opposing wall flaps, which may be supported by braces 323 from above. Each folding member 322 is generally configured to push the inner fold-down flaps and the index flap over each of the opposing sidewall flaps.

Figure 4A:
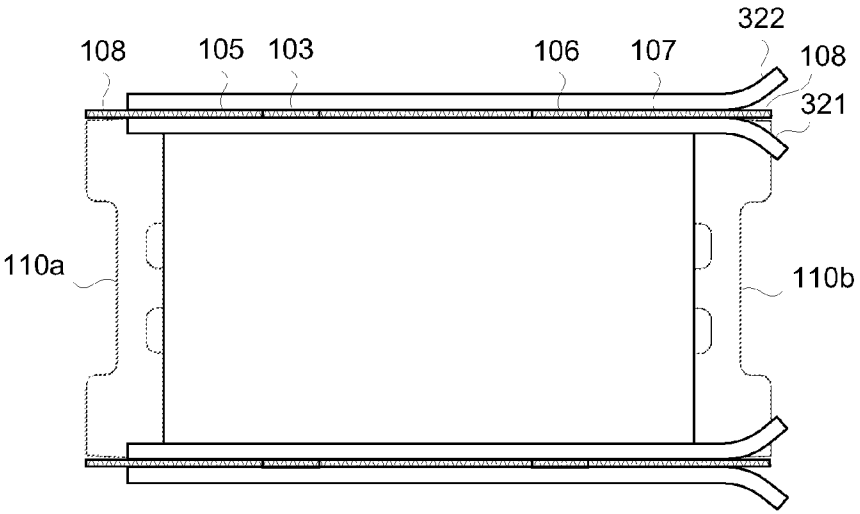
FIGS. 4A-F are views of an exemplary container blank and components of an exemplary apparatus for forming a container from the blank.
Figure 4B:
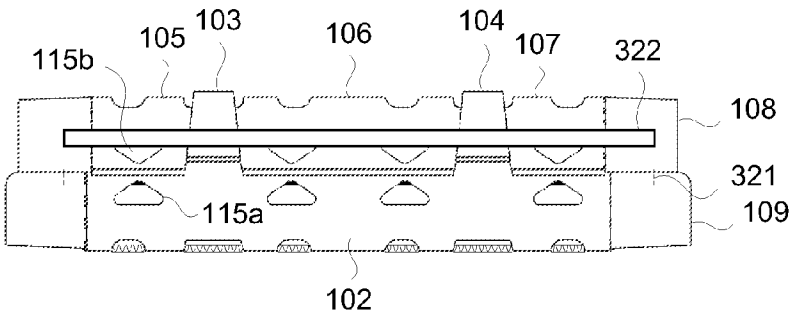

Referring now to FIGS. 4A and 4B, components of index folder 320 are shown with respect to a blank 100 as shown in FIG. 1. Reference numerals in FIGS. 4A and 4B are generally the same as those for corresponding structures in FIGS. 1 and 3. Holding members 321 may comprise a rod, bar, or other structure that is at least as long as the sidewall 102, not including extensions 109. Holding members 321 may advantageously have a guide section angled away from the inner surface of the sidewall flap (e.g., for guiding the blank into the proper position as it is moved along the conveyor 301). Holding members 321 are placed approximately at a fold line between the sidewall flap 102 and the inner fold-down flaps (e.g., at a fold line between sidewall 102 and inner fold-down flaps 105-107). A fold line between the index flaps 103 and 104 and the sidewall flap 102 is generally higher than the fold line between the sidewall flap 102 and inner fold-down flaps 105-107, thereby forming index tabs for aligning the formed container with index slots in other containers.

Figure 4D:
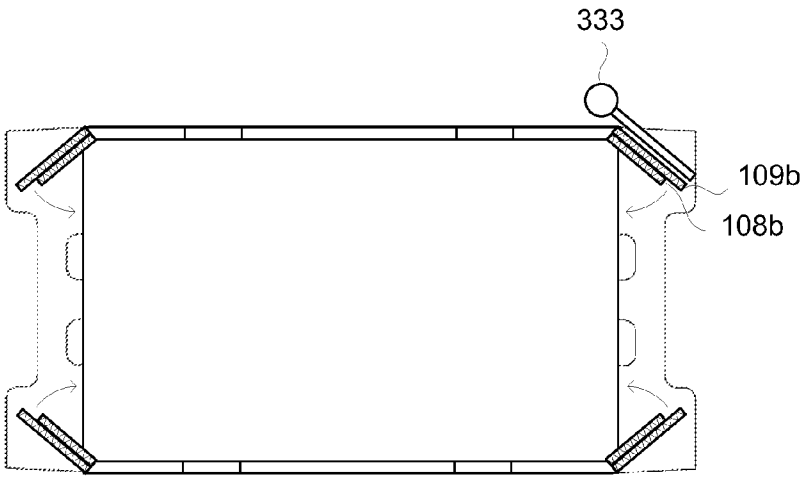
Figure 4F:
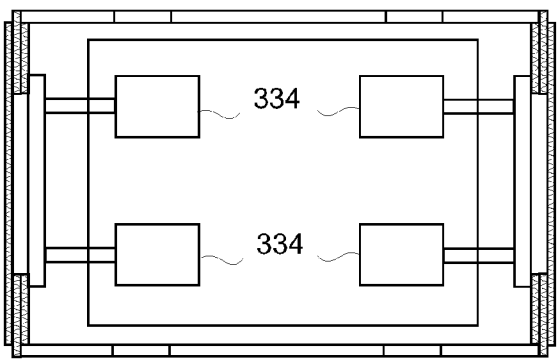
Figure 4C:
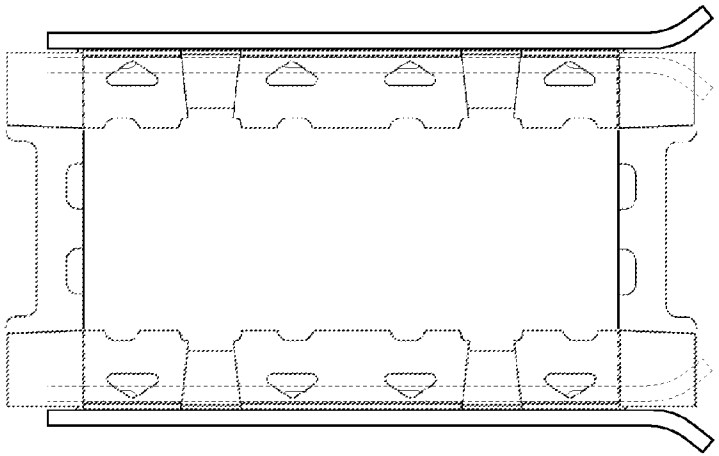

Referring now to FIG. 4C, folding members 322 may be pushed inward to pre-fold inner fold-down flaps 105-107 and index fold-down flaps 103 and 104. Holding members 321 remain in place to ensure that the fold lines are not deformed. For example, without holding member 321, the container may become deformed around venting cut-outs 115*a/b* (e.g., bulging or breaking around the top of the triangular cut-outs) when the fold-down flaps 105-107 are first folded. Referring again to FIG. 3, after index folder 320 pre-folds the container, conveyor 301 may deposit the blank at pressure former 330. Pressure former 330 may also include means known in the art for applying adhesives to the container. For example, pressure former 330 may include a plurality of spray heads for applying hot-melt glue or other fluid adhesives. Alternatively, pressure former 330 may include an automatic adhesive tape dispensing mechanism for applying adhesive tape to the container.

Figure 4E:
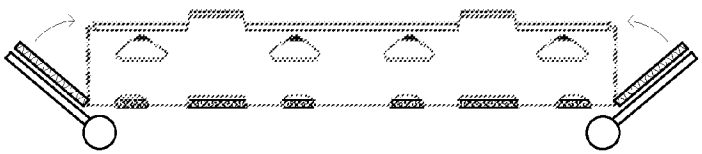

Referring again to FIG. 1, Leading extension 108*a* is foldably attached (e.g., at scored fold lines) to inner fold-down flap 105, trailing extension 108*b* is foldably attached to fold-down flap 107, and leading extension 109*a* and trailing extension 109*b* are foldably attached to sidewall 102. Referring now to FIG. 4D, a top view of the blank is shown after arriving at pressure former 330. Flaps 333 generally fold extension flaps 108*a/b* and 109*a/b* inwardly toward an angle of about 90 degrees with respect to the sidewalls of the container by folding arms 333. FIG. 4E shows a side view of the container at pressure former 330. After the extensions are folded, leading wall 110*a* and trailing wall 110*b* may be folded upwardly toward an angle of approximately 90 degrees with respect to the base of the container by folding arms 334.

FIG. 4F shows a top view of the container where leading wall 110*a* and trailing wall 110*b* are held in place by folding arms 334 while pneumatic presses 335 press the extensions against each other and against the leading and trailing walls. Preferably, presses 335 push long enough for the adhesive (e.g., adhesive tape, hot-melt glue, and/or other adhesives) to set so that the container can be released from the apparatus and stacked. In some embodiments, extensions 108*a/b* may each have a corner post section and an attachment section, where the corner post section is foldably attached to one of the inner fold-down flaps and the attachment section is foldably attached to the corner post section. Thus, the presses 335 may push the attachment section flat against extensions 109*a/b*, while the corner post sections form an angle of from 30 degrees to 60 degrees with respect the sidewall flaps (thereby forming, e.g., a gusset or corner support structure in the corners of the container).

An Exemplary Method of Assembling a Container

Figure 5:
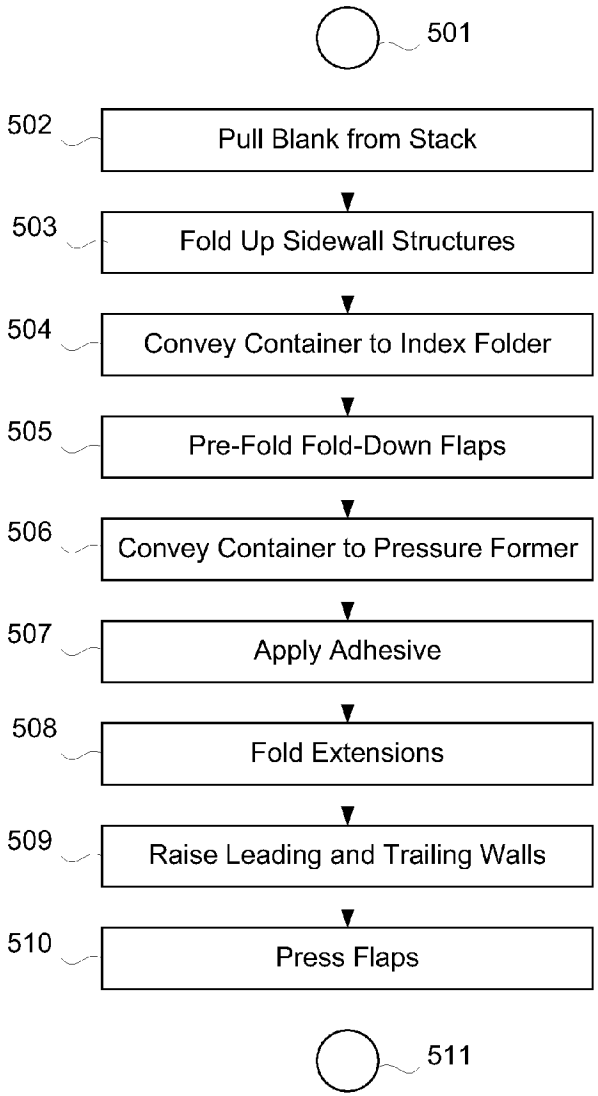
FIG. 5 is a flow diagram of an exemplary method of forming a container from a container blank.

Referring now to FIG. 5, a flow diagram showing an exemplary method of making a container in accordance with an embodiment of the present invention is indicated by the general reference character 500. The method begins at step 501. At step 502, a blank is pulled from a stack of container blanks (e.g., from blank magazine 311 of FIG. 3). At step 503, the sidewall structures (e.g., sidewall structure 120 of FIG. 1) are folded up from the base (e.g., by pulling the container through plows 312 of FIG. 3 positions at each side of the container as it is pulled toward conveyor 301). For example, step 502 may include forming a negative pressure in a plurality of vacuum cups attached to at least one picker arm, and applying the vacuum cups to the blank. Thus, step 503 may include pulling the blank between plow structures thereby folding the sidewalls at an angle of approximately 90 degrees with respect to the base.

At step 504, the container is conveyed to an index folder (e.g., index folder 320 of FIG. 3). At step 505, a plurality of inner fold-down flaps (e.g., inner fold-down flaps 105-107) and an index flap (e.g., index fold-down flap 103) are pre-folded (e.g., to "break" the corrugated material of the blank along the fold lines) over each of the two opposing sidewall flaps (e.g., sidewall flaps 102) of the blank. Pre-folding may include holding a first rod (e.g., holding member 321 of FIGS. 3-4C) against an inner surface of one of the opposing wall flaps and approximately at a fold line between the sidewall flap and at least one of the inner fold-down flaps. The fold line between the index flap and the sidewall flap may be higher than the fold line between the sidewall flap and at least one of the inner fold-down flaps. The pre-folding step may also include pushing the inner fold-down flaps and the index flap over each of the opposing sidewall flaps (e.g., with folding bar 322 of FIGS. 3-4C).

At step 506, the container is conveyed to the pressure former (e.g., pressure former 330 of FIG. 3). At step 507, adhesives (e.g., adhesive tape, hot-melt glue, and/or other adhesives) may be applied to one or more surfaces of the container. For example, hot-melt glue may be sprayed onto the container from a plurality of spray heads. Alternatively, adhesive tape may be applied to the container.

At step 508, the sidewall extensions (e.g., extensions 108*a/b* and/or 109*a/b*) are folded inwardly at an angle of about 90 degrees with respect to the sidewall. At step 509, the leading and/or trailing walls (e.g., leading wall 110*a* and/or trailing wall 110*b*) are folded at an angle of about 90 degrees with respect to the base of the container.

At step 510, the extensions are pressed against each other and against the leading and trailing walls, and the fold-down flaps are pressed against the sidewall. Preferably, the extensions and flaps are pressed long enough for the adhesive (e.g., adhesive tape, hot-melt glue, and/or other adhesives) to set so that the container can be released and stacked. Referring now to FIG. 1, in preferred embodiments extensions 108*a/b* are pressed flat against extensions 109*a/b*. However, in some embodiments the extensions 108*a/b* may each have a corner post section and an attachment section, where the corner post section is foldably attached to one of the inner fold-down flaps and the attachment section is foldably attached to the corner post section. Thus, in the alternative embodiment the step 510 may include pushing the attachment section flat against extensions 109*a/b*, while the corner post sections form an angle of from 30 degrees to 60 degrees with respect the sidewall flaps (thereby forming, e.g., a gusset or corner support structure in the corners of the container).

CONCLUSION

Thus, embodiments of the present invention relate to apparatuses and methods for forming container structures (e.g., by assembling pre-cut and/or pre-scored blank. Embodiments of the present invention advantageously provide a reliable approach for forming a container from a blank with relatively fewer folding defects. The embodiments are particularly advantageous for containers with sidewall structures including a plurality of inner fold-down flaps and at least one index fold-down flap folded over a sidewall panel, where the fold line of the index fold-down flap is higher than the fold line of the inner fold-down flaps.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An apparatus for forming a stackable container from a container blank, said apparatus comprising:

a blank feeder configured to place said blank on a conveyor;

plow structures configured to fold two opposing sidewalls of said container blank at an angle of approximately 90 degrees with respect to a base of said container blank;

an index folder comprising two parallel holding members and two folding members parallel to said holding members, said index folder configured to pre-fold a plurality of fold-down flaps and an index flap over each opposing sidewall flap of said two opposing sidewalls, each of said holding members contacting an inner surface of one of said opposing sidewall flaps below a first fold line between said index flap and said sidewall flap and approximately at a second fold line between said sidewall flap and at least one of said fold-down flaps, and each of said folding members configured to push against an outer surface of said plurality of fold-down flaps and said index flap above said first and second fold lines, wherein said index flap is configured to form an index tab protruding above said second fold line when folded at an angle of 180° with respect to said sidewall flap; and a pressure former configured to attach a first leading extension to a leading wall of said blank and a first trailing extension to a trailing wall of said blank, wherein said first leading extension and said first trailing extension are foldably attached at an angle of about 90 degrees to one of said fold-down flaps or one of said sidewall flaps.

2. The apparatus of claim 1, wherein each of said holding members comprises a straight section along the length of said sidewall flap.

3. The apparatus of claim 2, wherein each of said holding members further comprises a guide section angled away from said inner surface of said sidewall flap.

4. The apparatus of claim 1, wherein said conveyor is configured to move said blank from said blank feeder to said index folder, and from said index folder to said pressure former.

5. The apparatus of claim 1, wherein said first leading extension is foldably attached at an angle of approximately 90 degrees to an edge of said sidewall flap nearest said leading wall and said first trailing extension is foldably attached at an angle of approximately 90 degrees to an edge of said sidewall flap nearest said trailing wall.

6. The apparatus of claim 5, wherein said pressure former is further configured to attach a second leading extension foldably attached to one of said fold-down flaps to said first extension and to attach a second trailing extension foldably attached to one of said fold-down flaps to said first trailing extension.

7. The apparatus of claim 6, wherein said second leading extension and said second trailing extension each comprise a corner post section and an attachment section, wherein said corner post section is foldably attached to one of said fold-down flaps and said attachment section is foldably attached to said corner post section.

8. The apparatus of claim 7, wherein said pressure former is further configured to:

fold each of said corner post sections at an angle of from 30 degrees to 60 degrees with respect to one of said sidewall flaps;

fold each of said attachment sections at an angle of approximately 90 degrees with respect to one of said sidewall flaps; and attach each of said attachment sections to one of said first leading extensions or said first trailing extensions.

9. The apparatus of claim 8, wherein said pressure former further comprises a press configured to push one of said attachment sections against one of said first leading extensions or said first trailing extensions.

10. The apparatus of claim 1, further comprising an adhesive applicator configured to apply adhesive to one or more surfaces of said blank.

11. The apparatus of claim 10, wherein said adhesive comprises adhesive tape and/or hot-melt glue.

12. The apparatus of claim 1, wherein said blank feeder comprises at least one picker arm having a plurality of vacuum cups mounted thereon.

13. The apparatus of claim 12, wherein said picker arm is configured to pull said blank between said plow structures and fold said sidewalls at an angle of approximately 90 degrees with respect to said base.

14. The apparatus of claim 1, wherein the holding member has a length about equal to a length of the folding member.

15. The apparatus of claim 14, wherein the length of the holding member and the folding member is greater than or equal to a length of the sidewall of the container blank.

16. A method for forming a stackable container from a container blank, said method comprising the steps of:

placing said blank on a conveyor;

folding opposing sidewalls of said container blank at an angle of approximately 90 degrees with respect to a base of said container blank;

pre-folding a plurality of fold-down flaps and an index flap over each of two opposing sidewall flap of said opposing sidewalls, comprising placing a holding member against an inner surface of said each opposing wall flap below a first fold line between said index flap and said sidewall flap and approximately at a second fold line between said sidewall flap and said fold-down flaps, and pushing a folding member against an outer surface of said plurality of fold-down flaps and said index flap of each opposing sidewall above said first and second fold lines, wherein said folding member is parallel to said holding member, and said index flap is configured to form an index tab protruding above said second fold line when folded at an angle of 180° with respect to said sidewall flap; and attaching a first leading extension to a leading wall of said blank and a first trailing extension to a trailing wall of said blank, wherein said first leading extension and said first trailing extension are foldably attached at an angle of about 90 degrees to one of said fold-down flaps or one of said sidewall flaps.

17. The method of claim 16, further comprising moving said blank on said conveyor from a blank feeder configured to perform said placing to an index folder configured to perform said pre-folding, and from said index folder to a pressure former configured to perform said attaching.

18. The method of claim 16, wherein said attaching further comprises:

folding said first leading extension at an angle of approximately 90 degrees to an edge of said sidewall flap nearest leading wall; and folding said first trailing extension at an angle of approximately 90 degrees to an edge of said sidewall flap nearest said trailing wall.

19. The method of claim 18, further comprising:

attaching a second leading extension foldably attached to one of said fold-down flaps to said first extension; and attaching a second trailing extension foldably attached to one of said fold-down flaps to said first trailing extension.

20. The method of claim 19, wherein said second leading extension and said second trailing extension each comprise a corner post section and an attachment section, wherein said corner post section is foldably attached to one of said fold-down flaps and said attachment section is foldably attached to said corner post section.

21. The method of claim 20, further comprising:

folding each of said corner post sections at an angle of from 30 degrees to 60 degrees with respect to one of said sidewall flaps;

folding each of said attachment sections at an angle of approximately 90 degrees with respect to one of said sidewall flaps; and attaching each of said attachment sections to one of said first leading extensions or said first trailing extensions.

22. The method of claim 21, further comprising pushing one of said attachment sections against one of said first leading extensions or said first trailing extensions.

23. The method of claim 16, further comprising applying adhesive to one or more surfaces of said blank.

24. The method of claim 22, wherein said adhesive comprises adhesive tape and/or hot-melt glue.

25. The method of claim 16, wherein said placing comprises:

forming a negative pressure in a plurality of vacuum cups attached to at least one picker arm;

applying said vacuum cups to said blank; and pulling said blank between plow structures, thereby folding said sidewalls at an said angle of approximately 90 degrees with respect to said base.

26. The method of claim 16, wherein the holding member has a length about equal to a length of the folding member.

27. The method of claim 26, wherein the length of the holding member and the folding member is greater than or equal to a length of the sidewall of the container blank.

* * * * *